US007237687B1

(12) United States Patent
Abdi et al.

(10) Patent No.: US 7,237,687 B1
(45) Date of Patent: Jul. 3, 2007

(54) OVER THE DOOR HANGER SYSTEM

(75) Inventors: Abraham Abdi, Orange, CA (US); Charles L. Coulter, Riverside, CA (US); Terry Lee Oster, Temecula, CA (US)

(73) Assignee: Merrick Engineering, Inc., Corona, CA (US)

( * ) Notice: Subject to any disclaimer, the term of this patent is extended or adjusted under 35 U.S.C. 154(b) by 0 days.

(21) Appl. No.: 11/319,861

(22) Filed: Dec. 29, 2005

(51) Int. Cl.
*A47G 29/087* (2006.01)

(52) U.S. Cl. ..... 211/119.004

(58) Field of Classification Search ..... 211/119.004, 211/113, 88.04, 85.3, 16, 104, 118, 119.009, 211/195
See application file for complete search history.

(56) References Cited

U.S. PATENT DOCUMENTS

| | | | | | |
|---|---|---|---|---|---|
| 2,090,108 | A | * | 8/1937 | Cicero | 211/35 |
| 2,633,998 | A | * | 4/1953 | Derman et al. | 211/104 |
| D354,412 | S | * | 1/1995 | Emery | D6/548 |
| D377,728 | S | * | 2/1997 | Klein et al. | D6/570 |
| D419,349 | S | * | 1/2000 | Klein et al. | D6/552 |
| 6,052,918 | A | * | 4/2000 | Oletzke | 34/239 |

* cited by examiner

*Primary Examiner*—Sarah Purol
(74) *Attorney, Agent, or Firm*—G. Donald Weber, Jr.

(57) ABSTRACT

A hinged hanging device adapted to be mounted over the top of a door. The device can be adjusted to extend outwardly from the surface of the door to provide a support for conventional hangers or to fold substantially flat against the door surface.

20 Claims, 5 Drawing Sheets

100
101
102
103
104
105
106
107
109
110
111
112
113
114
115
116
117
118
119
120
121
122
123
500
501
502
502A
503
504

OVER THE DOOR HANGER SYSTEM

BACKGROUND OF THE INVENTION

1. Field of the Invention

This device is related to a storage unit, in general, and to a hinged and foldable storage unit which is adapted to hang from the top of a door, in particular.

2. Prior Art

There are many over-the-door storage and/or support devices known in the art. These devices include brackets which mount over the door and provide a support for items such as hangers or the like. Also, these types of devices include multiple pockets or supports for retaining shoes or the like. Typically, the shoe supports are fixed in position while the pocket units may collapse into a small dimension. However, the hanger supports are usually fairly rigid and extend outwardly from the door.

These hanger support devices may take the form of a small hook which supports one or two items or a larger bracket which extends substantially perpendicular to the door surface for supporting multiple hangers or similar devices substantially parallel to the surface of the door. In some cases, these hooks and/or brackets can be pivotally mounted in an over-the-door clip or attachment whereby the door can be placed close to a wall when the hook or bracket is not being used. However, this hood or bracket is limited in length to one half the width of the door which limits the number of hangers which can be supported. In addition, the hangers (and items thereon) are mounted parallel to the door surface which may be limitative of the number of items which can be mounted on the hook or bracket. Likewise, the hook or bracket is cantilevered from the door surface which limits the weight of the goods which can be hung on the bracket unless the bracket is made of relatively heave, strong material such as metal rods, or the like.

SUMMARY OF THE INSTANT INVENTION

A hinged hanging device adapted to be mounted over the top of a door. The device can be adjusted to extend outwardly from the surface of the door to provide a support for conventional hangers or to fold substantially flat against the door surface.

DESCRIPTION OF A PREFERRED EMBODIMENT

Figure 1:
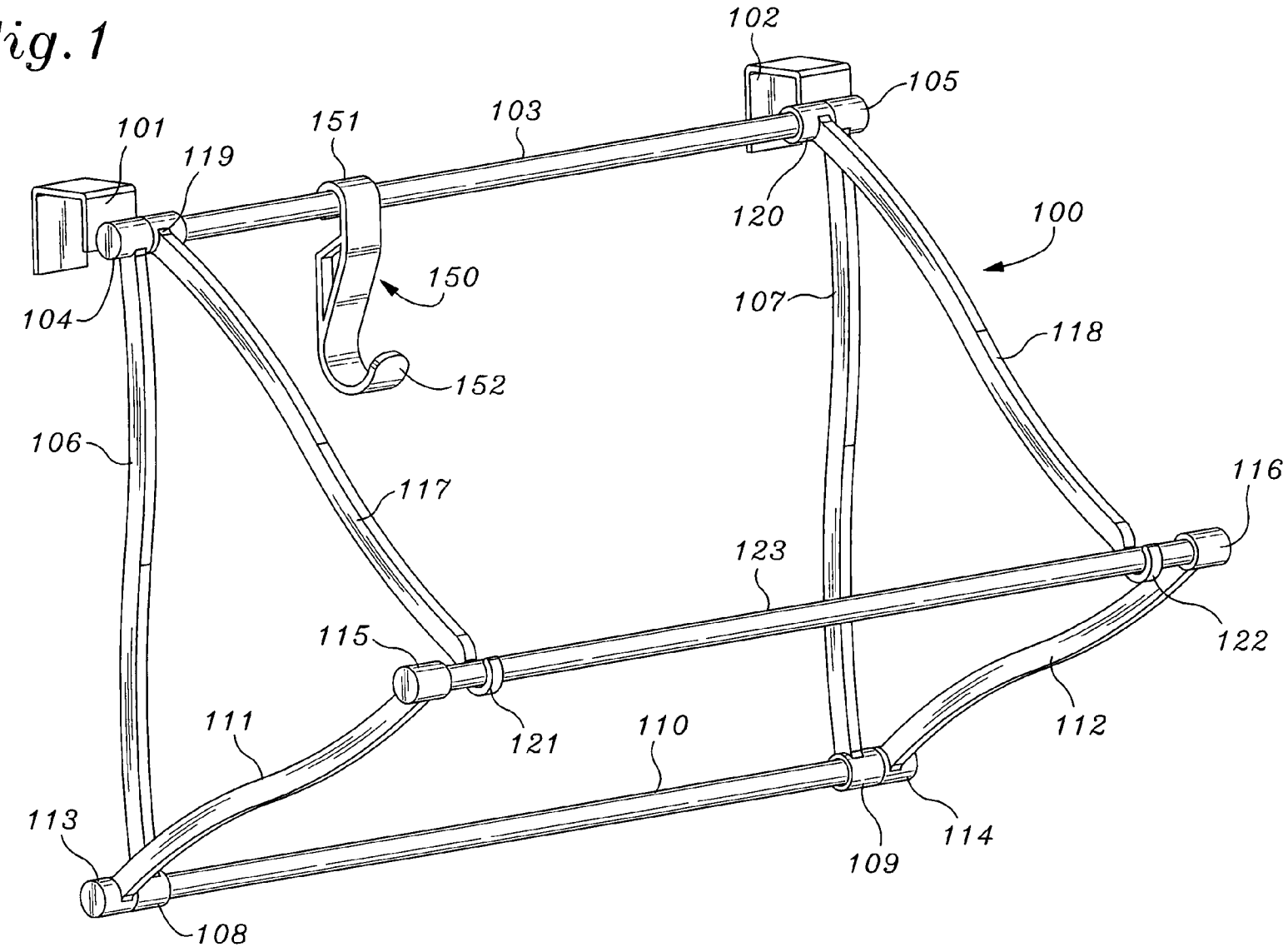
FIG. 1 is a perspective view of the assembled support device in the operative state.
Figure 2:
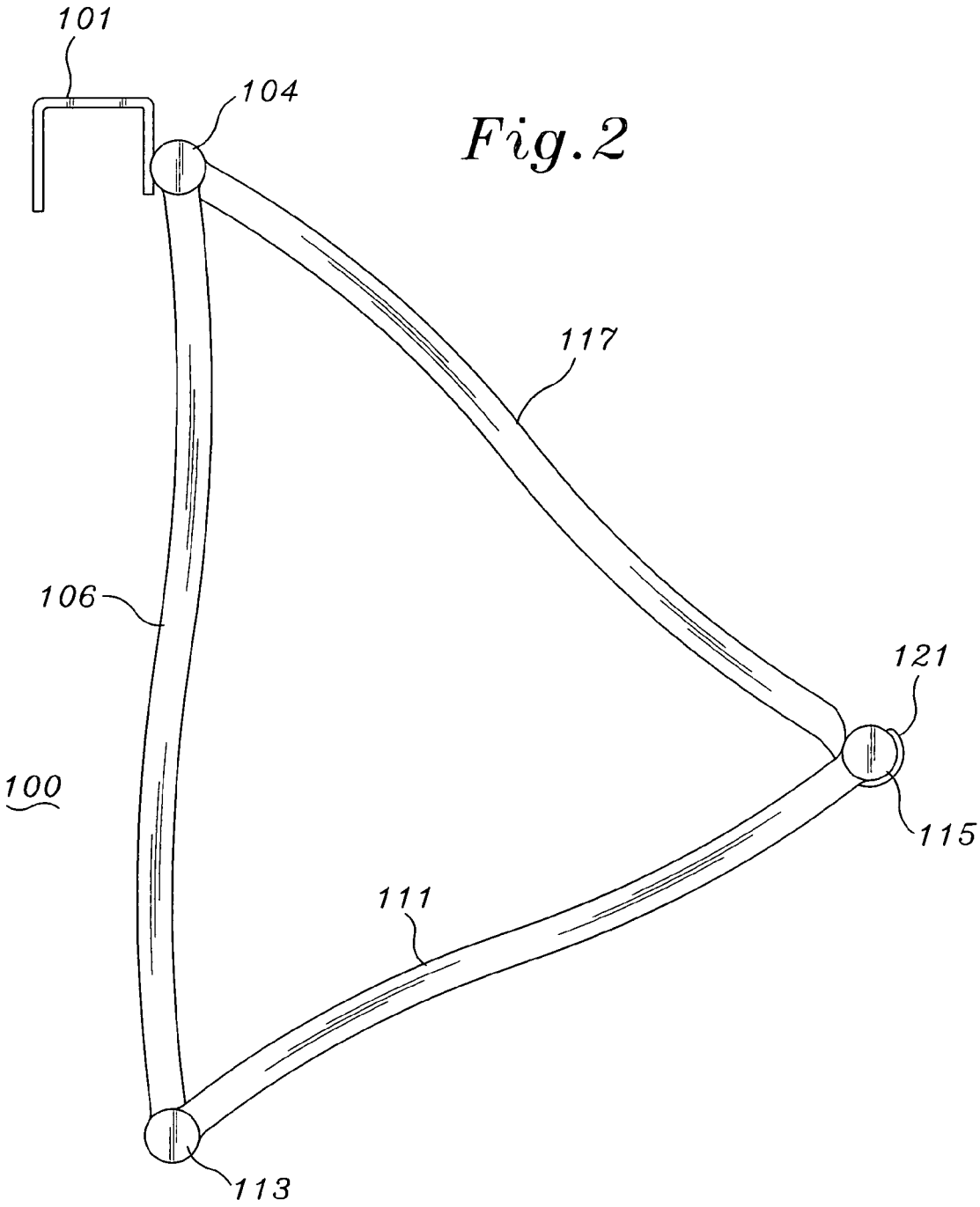
FIG. 2 is an end view of the support apparatus in the operative state.
Figure 3:
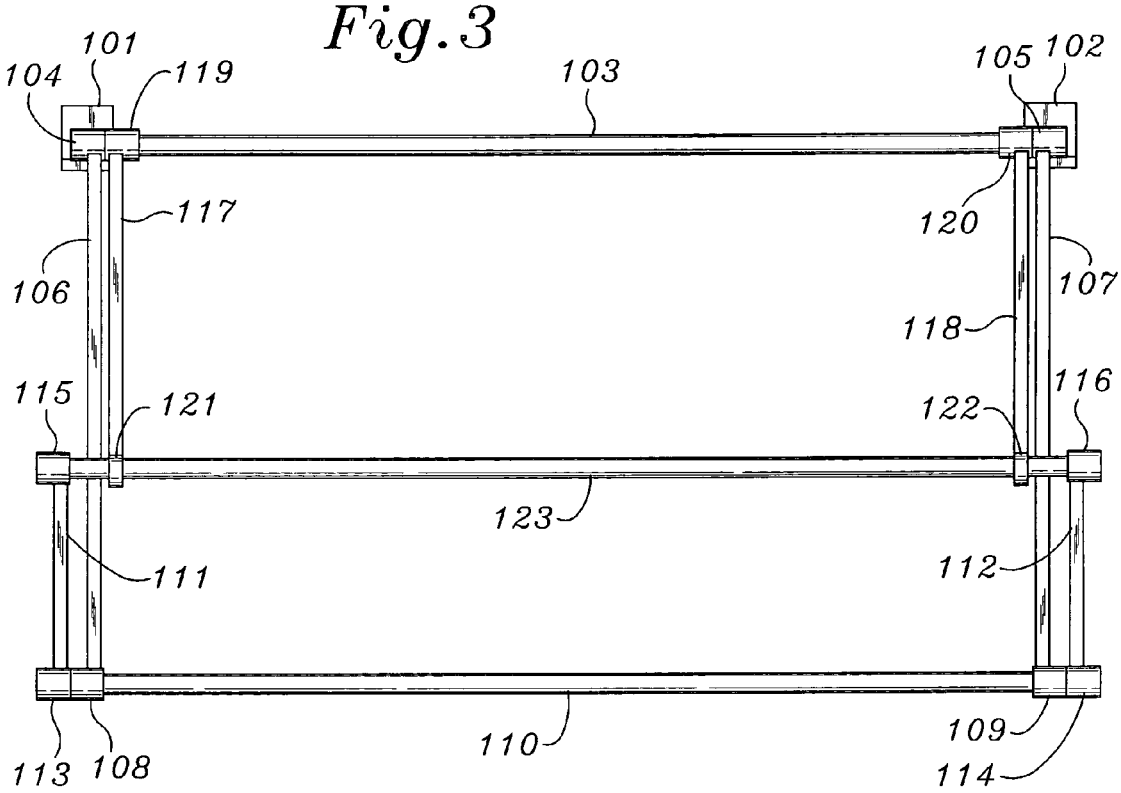
FIG. 3 is a frontal view of the support apparatus in the operative state.
Figure 4:
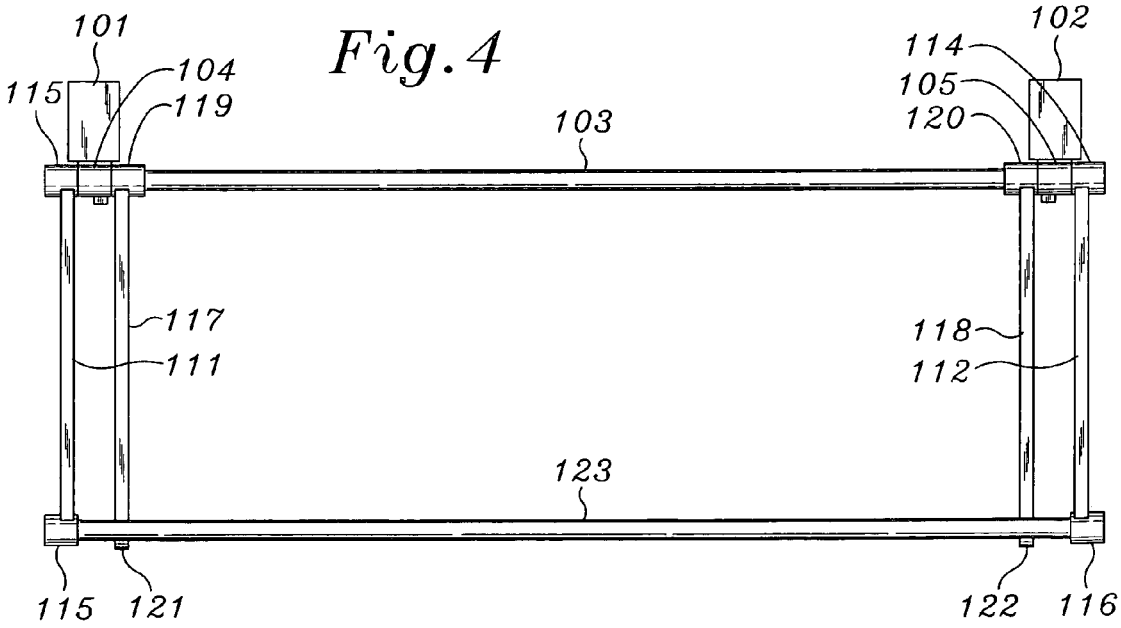
FIG. 4 is a top view of the support apparatus in the operative state.

Referring concurrently to FIGS. 1-4, there are shown several views of hanging device 100 of the instant invention in the assembled and operating state. The device 100, often referred to as an over-the-door valet includes hooks 101 and 102 for engaging the top of a conventional door (not shown).

The hooks 101 and 102, as shown, are preferably formed of a unitary component with three sides in the form of an inverted U-shape. Two of the sides are parallel to each other. This configuration permits the supporting door to close properly with the device 100 mounted therein. The hooks 101 and 102 can be formed of any suitable material, such as plastic, metal or the like, with the appropriate structural strength to support the hanging device 100 and the items supported thereby.

The hooks 101 and 102 include end caps 104 and 105, respectively which rotatably receive the ends of upper support bar 103. Alternatively, the hooks 101 and 102 may include end loops, i.e. caps without a surface, which receive the support bar 103 adjacent to the ends thereof. The upper support bar 103 can be fabricated of plastic, metal or any suitable material and may be solid rods or hollow bars. The width of the device 100 can be altered by altering the length of support bar 103 as described.

In the preferred embodiment, upper end bars 106 and 107 are connected to and depend from the end caps 104 and 105, respectively which end caps are integrally formed with the hooks 101 and 102.

The upper end bars 106 and 107 are shown formed in a somewhat sinuous or curved configuration. This shape is desirable but is not required in order to utilize the inventive support device. The shape is advantages to assure that the lower ends of the upper bars 106 and 107 and, thus, the overall device 100 are positioned closely to the supportive door or other frame.

Intermediate bar 110 is joined to the nether or lower ends 108 and 109 of the upper end bars 106 and 107, respectively. The intermediate bar 110 may be fixedly or rotatably joined to the nether ends 108 and 109. In the preferred rotatable joining, the ends 108 and 109 are formed as open loops, preferably cylindrical in shape which snugly engage the intermediate bar 110.

Intermediate bar 110 which can be fabricated of metal, plastic or other suitable material passes through the openings in the loops or hollow cylinder at the ends 108 and 109. The bar 110 can be a solid bar or a hollow rod as desired. As in the case of bar 103, bar 110 can be adjusted in length.

Lower end bars 111 and 112 depend from intermediate bar 110. In a preferred embodiment, ends 113 and 114 of end bars 111 and 112, respectively, are formed as hollow cup-like receptacles at the upper ends of lower end bars 111 and 112. The end receptacles 113 and 114 snugly engage the ends of intermediate bar 110 so that bar 110 tends to rotate with the ends 113 and 114 thereof. The lower end bars are shown with a sinuous or curved configuration similar to upper end bars 106 and 107.

The lower end bars 111 and 112 also include cup-like receptacles 115 and 116 at the nether ends thereof which are similar to the cap-like receptacles 113 and 114 described supra. The receptacles 115 and 116 snugly engage the lower support bar 123 so as to permit little or no rotation of lower support bar 123 relative to receptacles 115 and 116.

Lower support bar 121 is similar to upper support bar 103 and intermediate support bar in construction and can be altered to any desired length.

Positioning bars 117 and 118 include hollow cylindrical loops 119 and 120 at the upper ends thereof, respectively. The loops 119 and 120 are arranged to receive upper support bar 103 therethrough so that the positioning bars 117 and 118 are rotatable around upper support bar 103.

Positioning bars 117 and 118 also include open hooks 121 and 122 at the respective lower ends thereof. The hooks 121 and 122 are configured to selectively receive and loosely (but securely) capture the lower support bar 123.

Optional hooks 150 (described in detail hereinafter) are adapted to be mounted on any of the horizontal bars, i.e. upper and lower support bars as well as the intermediate bar 110.

Hook 150 includes a larger hook 151 at one end for snugly but removably engaging the horizontal bars as noted supra. Hook 150 also includes another, typically smaller, hook 152 at the other end thereof for receiving objects to be individually hung on the hanging device. Of course, a plurality of hooks 150 can be used to support one or more objects, if so desired.

Typically, the hooks 151 and 152 are faced in opposite directions for convenience although this is not a requirement, per se, of the invention.

As shown in FIG. 1, the hanging device 100 is assembled and disposed in the "operating" configuration. Typically, in this configuration the hooks 101 and 102 are placed over and in engagement with a support structure such as a door, a partition, a frame or the like (not shown). The end caps 104 and 105 on the hooks 101 and 102 respectively engage and support the upper support bar 103 which is, typically, a rod or tube.

The upper end bars 106 and 107 are integrally formed with the end caps 104 and 105, respectively. Thus, the upper end bars depend from the end caps 104 and 105 and, therefore, from the hooks 101 and 102.

The intermediate support bar 110 is rotatably mounted in the nether ends 108 and 109, typically, loops at lower ends of the upper end bars 106 and 107, respectively. Intermediate support bar 110 is joined to the end caps 113 and 114 respectively of lower end bars 111 and 112 and rotates therewith.

Lower support bar 123 is joined to the receptacles or end caps 115 and 116 at the nether ends of lower end bars 111 and 112 respectively.

In the assembled configuration, the positioning bars 117 and 118 are rotated around upper support bar 103 so that the hooks 121 and 122 engage the lower support bar 123 in a position which is spaced away from the support door, partition or the like.

In this position, hangers (not shown) or any other item, including hook 150, can be conveniently placed over or hung from lower support bar 123.

While the apparatus 100 will remain in the configuration shown in FIG. 1 until lower support bar 123 is selectively detached from hooks 121 and 122, the application of weight (force) to bar 123 by hanging items therefrom, enhances the interaction between hooks 121 and 122 (and, thus, positioning bars 117 and 118) to maintain the apparatus in the operational position shown in FIG. 1.

On the other hand, if nothing is hanging from lower support rod 123 and the supporting door is opened, i.e., coming inwardly toward a wall, the device 100 is designed to fold inwardly into itself to permit operation of the door and to minimize impact with the wall.

Figure 6:
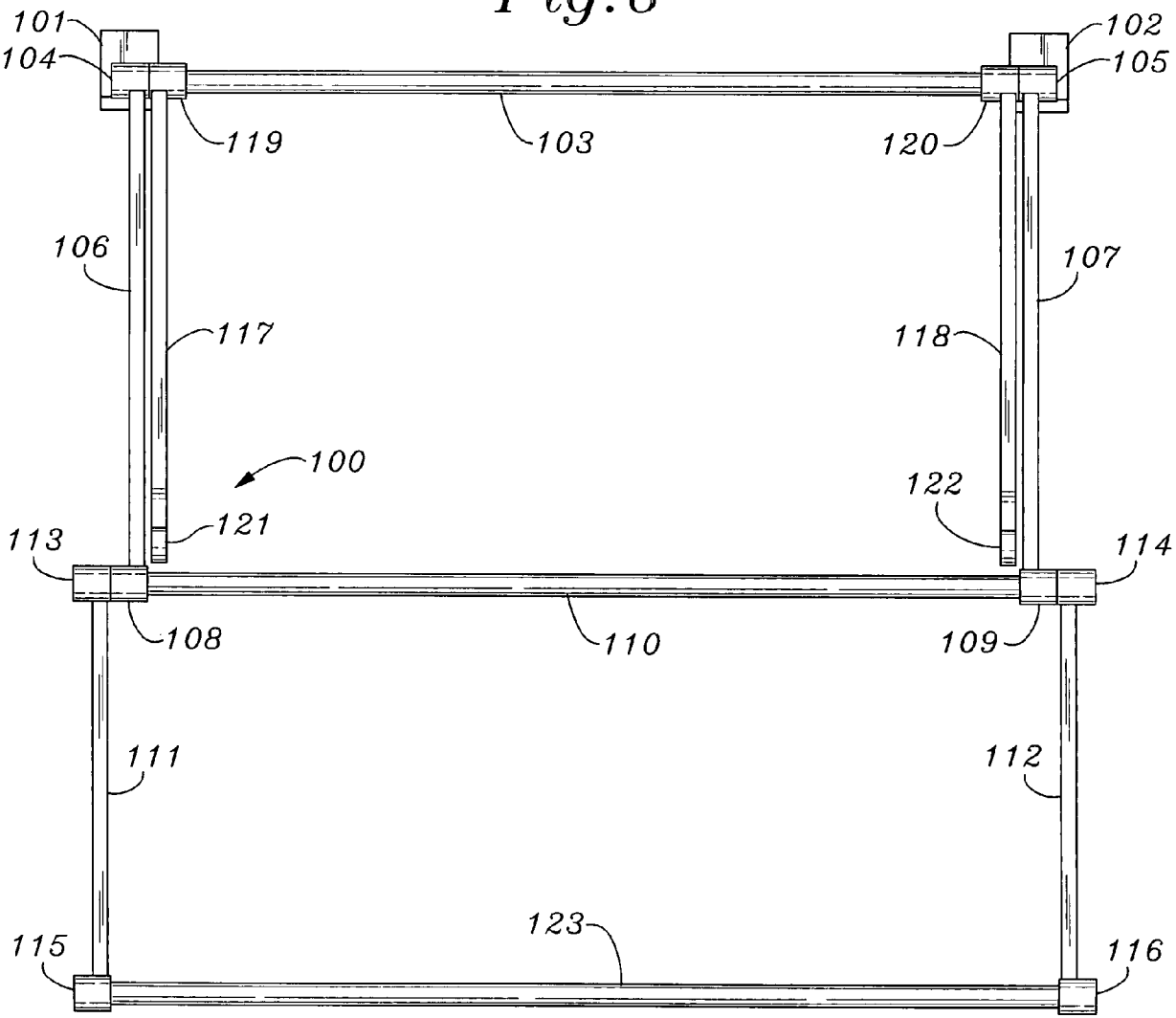
FIG. 6 is a frontal view of the apparatus in the downward closed state.
Figure 5:
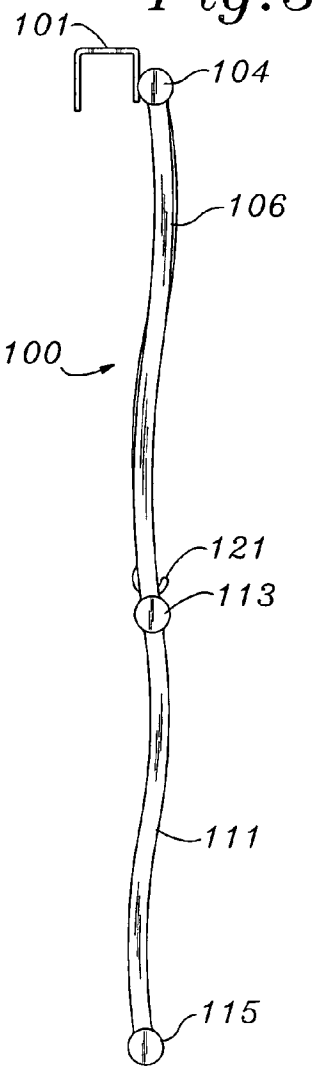
FIG. 5 is an end view of the support apparatus in the downward closed state.
Figures 7, 8, 9, 10:
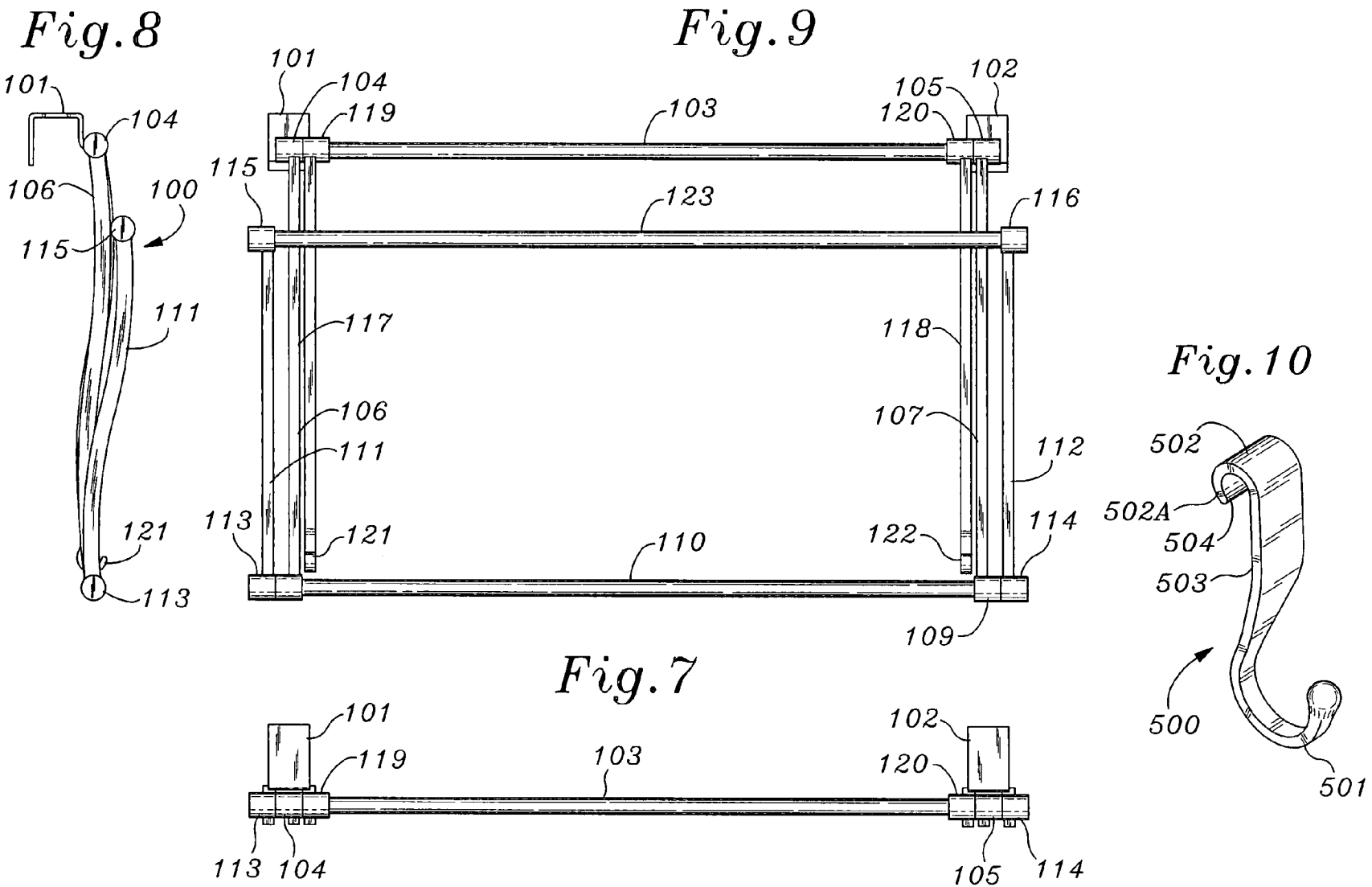
FIG. 7 is a top view of the support apparatus in the downward closed state.
FIG. 8 is an end view of the support apparatus in the upward closed state.
FIG. 9 is a frontal view of the support apparatus in the upward closed state.
FIG. 10 is a perspective view of one embodiment of a hook device which is adapted for use with the support apparatus of the instant invention.

Referring now to FIGS. 5, 6 and 7 concurrently, there are shown a side, a front and a top view, respectively, of the support apparatus 100 in the closed downward state. In this state, the apparatus 100 is closed so that the apparatus does not extend outwardly from the support unit such as a door, a partition or the like.

In this state, the lower support bar 123 is removed from hooks 121 and 122. The lower part of the support apparatus 100 which comprises lower support bar 123 and the lower end bars 111 and 112 rotate downwardly around (or with) the intermediate bar 110 relative to the bar ends (or loops) 108 and 109. This lower part of the apparatus depends downwardly and substantially in-line with the upper part of the apparatus.

Likewise, the positioning bars 117 and 118 rotate around the upper end bar 103 at the respective connectors 119 and 120, respectively. The positioning bars are substantially aligned with the upper end bars 106 and 107 in this configuration. Thus, the profile of the apparatus in the downward closed condition (see FIG. 5) is quite small. As a result, the apparatus occupies a minimal space when not in use with the clear advantages thereof.

Referring now to FIGS. 8 and 9 concurrently, there are shown a side and a front view, respectively, of the support apparatus 100 in the closed upward state. In this state, the apparatus 100 is closed so that the apparatus does not extend outwardly from the support unit such as a door, a partition or the like.

In this state, the lower support bar 123 is removed from hooks 121 and 122. The lower part of the support apparatus 100 which comprises lower support bar 123 and the lower end bars 111 and 112 rotate upwardly around (or with) the intermediate bar 110 relative to the bar ends (or loops) 108 and 109. This lower part of the apparatus depends downwardly from hooks 101 and 102 but upwardly substantially in line with the upper part of the apparatus.

Likewise, the positioning bars 117 and 118 rotate around the upper end bar 103 at the respective connectors 119 and 120, respectively. The positioning bars are substantially aligned with the upper end bars 106 and 107 in this configuration. Thus, the profile of the apparatus in the upward closed condition (see FIGS. 7 and 8) is quite small. As a result, the apparatus occupies a minimal space when not in use with the clear advantages thereof. Because of the snug fit of the end caps 115 and 116, in particular, the apparatus 100 will remain in this position until repositioned by the user.

In a preferred embodiment, the hanging device or apparatus is fabricated of a lightweight material of sufficient strength to provide the desired support function. For example, the components can be fabricated of a suitable plastic material such as, but not limited to, polypropylene. For additional support strength, the horizontal supports bars can be fabricated of a metal such as aluminum, steel or the like.

Referring now to FIG. 10, there is shown a perspective view of one type of hook 500 which is adapted to be used with the support apparatus 100. The hook, 500 is, typically fabricated of a plastic material such as polypropylene, or the like, and includes a small hook end 501 and a large hook end 502 formed at opposite ends of a connector body 503.

The larger hook 502 is, generally, partially cylindrical in shape with an opening toward the center of the connector body. The hook 502 has a reversed end 502A which defines an opening (relative to the connector body 503) which is slightly smaller than the diameter of the cylindrical shape of the hook. This arrangement permits the flexible hook end 502A to spread apart to receive one of the horizontal bars 103, 110 or 123 of the apparatus 100. The reversed end 502A may, in a preferred embodiment, include an optional small lip 504 which engages the horizontal support bar to retain the hook 500 in snug, but removable, relation. Hook end 501 is shaped in any convenient configuration to receive objects to be hung thereon. A suitable hook is shown and described in co-pending application entitled TAPERED HOOK by Abraham Abdi, et al, executed on Feb. 23, 2004, filed on Feb. 25, 2004 and bearing Ser. No. 29/200,116.

Thus, there is shown and described a unique design and concept of an over the door hanger system. While this description is directed to particular embodiments, it is understood that those skilled in the art may conceive modifications and/or variations to the specific embodiments shown and described herein. Any such modifications or variations which within the purview of this description are intended to be included therein as well. It is understood that the description herein is intended to be illustrative only and is not intended to be limitative. Rather, the scope of the invention described herein is limited only by the claims appended hereto.

The invention claimed is:

1. A collapsible support apparatus comprising, hook means for selectively attaching the apparatus to a supporting structure and including end caps for receiving an upper support bar means, upper end bar means integral with said end caps, said end caps and said upper end bar means dependent from said hook means, lower end bar means dependent from said upper end bar means, positioning bar means dependent from said upper support bar means, and retention means on said positioning bar means to selectively retain a lower support bar means in a prescribed operative supporting condition and to readily release said lower support bar means when said lower support bar means is not in the prescribed operative supporting condition.

2. The apparatus recited in claim 1 wherein, said hook means includes at least two spaced apart hook devices.

3. The apparatus recited in claim 2 wherein, each of said hook devices includes an inverted U-shaped hook.

4. The apparatus recited in claim 1 including, an upper support bar means detachably mounted to said integrally formed upper end bar and hook means.

5. The apparatus recited in claim 4 including, an intermediate support bar means mounted to said upper end bar means but spaced away from and in the same plane with said upper support bar means.

6. The apparatus recited in claim 5 including, a lower support bar means mounted to said lower end bar means and selectively connected with said retention means on said positioning bar means.

7. A collapsible support apparatus comprising, hook means including at least two spaced apart hook devices for selectively attaching the apparatus to a supporting structure, upper end bar means integrally formed with and dependent from each of said hook means, upper support bar means mounted to said upper end bar means and said hook means, lower end bar means rotatable mounted to an intermediate support bar means, positioning bar means rotatably mounted on and dependent from said upper support bar means intermediate said hook devices, lower support bar means mounted to said lower end bar means, and retention means on said positioning bar means to selectively retain said lower support bar means in a prescribed operative position.

8. The apparatus recited in claim 7 wherein, each of said hook devices includes an inverted U-shaped hook.

9. The apparatus recited in claim 7 wherein, said intermediate support bar means is mounted to said upper end bar means but spaced away from and in the same plane with said upper and lower support bar means.

10. The apparatus recited in claim 7 including, at least one independent hook unit engaged with one of said upper support bar means and said lower support bar means.

11. A collapsible support apparatus comprising, an upper horizontal bar, a lower horizontal bar, an intermediate horizontal bar, a pair of upper support arms each having a first receptacle at a first end thereof adapted to receive the opposite ends of said upper horizontal bar and a second receptacle at the other end thereof to rotatably receive said intermediate horizontal bar adjacent the opposite ends, a pair of lower support arms each having a first receptacle at a first end thereof adapted to receive the opposite ends of said lower horizontal bar and a second receptacle at the other end thereof to receive the opposite ends of said intermediate horizontal bar, said first receptacle of each said upper support arms and the first and second receptacles of each said lower support arms is cup-shaped, and at least one positioning arm rotatably mounted to said upper horizontal bar, each said positioning arm including retainer means for selectively retaining said lower horizontal bar therein.

12. The apparatus recited in claim 11 including, hook means integrally joined to said first receptacles at said first end of said upper support arms for mounting said apparatus to a support structure.

13. The apparatus recited in claim 11 including, a receptacle formed at a first end of each of said positioning arm for mounting to said upper horizontal bar.

14. The apparatus recited in claim 11 wherein, each said second receptacle of said upper support arms is in the form of a loop for receiving said intermediate horizontal bar.

15. The apparatus recited in claim 7 including, attachment means adapted to engage any one of said upper support bar means and said lower support means and to receive items to be supported by said attachment means.

16. The apparatus recited in claim 15 wherein, said attachment means includes first and second hook ends at the opposite ends of a hook body.

17. The apparatus recited in claim 16 wherein, said first and second hook ends are of different widths relative to said hook body.

18. The apparatus recited in claim 11 wherein, each of said support arms is fabricated of plastic, metal or wood.

19. The apparatus recited in claim 1 wherein, at least one of said upper end bar means, said lower end bar means and said positioning bar means is formed in a curved configuration.

20. The apparatus recited in claim 11 wherein, said bars and said arms are fabricated as solid rods or hollow tubes.

* * * * *